US005222271A

United States Patent [19]

Eganhouse

[11] Patent Number: 5,222,271

[45] Date of Patent: Jun. 29, 1993

[54] SPECULUM CLEANER

[76] Inventor: Thomas J. Eganhouse, 445 Aurora Ave., Naperville, Ill. 60540

[21] Appl. No.: 911,187

[22] Filed: Jul. 9, 1992

[51] Int. Cl.[5] ..... A46B 11/00; A46B 15/00; A47L 25/00

[52] U.S. Cl. ..... 15/104.92; 15/104.04; 15/104.05; 15/160; 15/164

[58] Field of Search ..... 15/104.92, 104.03, 104.04, 15/104.05, 88, 75, 76, 160, 164, 210.1

[56] References Cited

U.S. PATENT DOCUMENTS 2,908,598 10/1959 Bowe et al. ..... 15/75
2,955,304 10/1960 Noe ..... 15/75
3,076,988 2/1963 Mills ..... 15/104.03
3,224,029 12/1965 Domingos ..... 15/104.92
3,266,075 8/1966 Conrad .
4,171,167 10/1979 Swartwout .
4,184,222 1/1980 Wootten ..... 15/164
4,439,884 4/1984 Giorni .
4,554,696 11/1985 Nye, Jr. ..... 15/76
4,575,892 3/1986 Ross ..... 15/160
4,862,549 9/1989 Criswell et al. .
5,094,557 3/1992 Nelson et al. .

*Primary Examiner*—Edward L. Roberts
*Attorney, Agent, or Firm*—Welsh & Katz, Ltd.

[57] ABSTRACT

A cleaning apparatus for cleaning speculums of the type which are generally conically configured and which having an insertion end. The housing has an inner cleaning area and a closure with an opening to provide access to the inner cleaning area. At least one primary brush member is secured within the inner cleaning area and is configured to remove residue on the insertion end of the speculum. Secondary brush members are also secured within the inner cleaning area, and are positioned alongside the primary brush member. The opening in the closure is aligned with the brush members to permit the cleaning of the insertion end of the speculum when it is inserted into the cleaning area through the opening.

9 Claims, 2 Drawing Sheets

SPECULUM CLEANER

SPECULUM CLEANER

The present invention relates generally to a hand-held container which includes internally mounted brush members, and which is configured for accepting the insertion end of a speculum for cleaning and/or disinfecting.

BACKGROUND OF THE INVENTION

A medical speculum is a generally conical instrument which is used to facilitate inspection of a body orifice. Typically, speculums are configured for easy removability and attachment to a hand-held instrument, such as an otoscope. Physicians most commonly use speculums for examining the ears or nostrils of humans or animals. The typical speculum is designed so that a doctor can easily look into body orifices to examine for medical problems. To help prevent transmission of disease or infection between patients, once a speculum has been used on a patient, it is either disposed of or set aside for subsequent cleaning.

Typically, especially with respect to veterinary use, the speculums can be expensive. If the veterinarian is making numerous calls or examining a multitude of animals, such as a herd of livestock, a large number of speculums must be carried along, such that the speculum is changed between examining each animal. Not only is it expensive to purchase and maintain the required number of speculums, but it is also tedious and time consuming to remove the used speculum and replace it with a new one between each patient being examined. If not disposed of, then the speculums are generally cleaned by hand.

The insertion end of a speculum is the portion of the speculum that is inserted into the body passageway and, therefore, is typically the portion which becomes soiled with residue and is unsanitary. However, it is difficult to adequately clean the narrow passageway that forms this insertion end of the speculum. Accordingly, instead of expending valuable time or risking the spread of disease or infectious germs, the doctor may decide to simply dispose of the speculum. If the doctor decides to recycle the speculum, a pointed object with a cloth draped over it may be inserted into and through the inside of the speculum to clean the insertion end properly. Other cleaning techniques may be used by the physician, but are equally inadequate. Not only are these techniques time consuming and tedious, but they are insufficient to properly clean the speculum, especially the passageway at the insertion end.

It is also common that body fluids, such as blood, mucous or sebum (wax) can form a film that is difficult to remove from the speculum by merely washing or wiping it out. Currently used speculum cleaning techniques are generally ineffective in removing the bodily substances, especially from the narrow insertion end of the speculum.

First, these residues can spread disease and infection. Second, these accumulated residues can obstruct the doctor's view of the body cavity being examined and thereby prevent the proper examination of that body cavity. Thus proper cleaning of the speculum not only helps to prevent the transmission of disease or infection, but also clears obstruction. Also, proper cleaning of the speculum is a prerequisite to adequate sterilization and sanitizing processes.

Millions of dollars of materials are wastefully disposed of each year because they are too expensive to recycle. The disposal of used medical items, such as speculums, is also becoming a logistical and economic burden which is ultimately passed on to the consumer.

Therefore, there is a need for an inexpensive container which is adapted for cleaning speculums or other speculum-like items, which is hand-held and which is quick and easy to use.

SUMMARY OF THE INVENTION

Accordingly, it is an object of the present invention to provide a speculum cleaning apparatus, which is easily transportable, and which provides the user with an inexpensive, yet effective, way to clean and disinfect a speculum.

It is a further object of the present invention to provide an easy to use, inexpensive, hand-held speculum cleaning device for cleaning a speculum, which includes brush members for removing residue quickly and easily without damaging the speculum or injuring the user.

In accordance with the present invention, all of the objects, as well as others not herein specifically identified, are achieved generally by the present speculum cleaner, including a generally cylindrical container having at least one brush member or scrubber, typically configured as a centrally located brush mounted within an inner cleaning area or chamber of the container. Secondary brush members are also included to enable the cleaning of the outer surface of the speculum. These secondary brush members are preferably located radially alongside the primary brush member, are equidistant apart and are at least the height of the primary brush member. The brush members may be removably secured to the interior of the container, and are configured and arranged so that the inner and outer surfaces of the insertion end of the speculum may be thoroughly cleaned of residue. Further, the container is configured to hold a predetermined amount of cleaning or disinfectant solution, which together with the brush members, cleans the insertion end of the speculum.

BRIEF DESCRIPTION OF THE DRAWINGS

Further objects of the invention, together with additional features contributing thereto and advantages occurring therefrom, will be apparent from the following description of the invention when read in conjunction with the accompanying drawings, wherein.

DETAILED DESCRIPTIONS OF THE INVENTION

Broadly stated, the present speculum cleaner includes a transportable, hand-held container for cleaning speculums of the type which are generally conically configured and having an insertion end. The container comprises a sufficiently rigid and generally cylindrical housing which defines an inner cleaning area or chamber.

The housing has a first end and a second end. The first end being closed and the second end providing access, to the inner cleaning area. A primary brush member has a lower end and an upper end. The lower end of the primary brush member is secured to the first end of the housing within the inner core. The upper end of the primary brush member is preferably configured with radiating bristles. Also included is at least one secondary brush member having a lower end and an upper end. The lower end is secured to the first end of the housing within the inner cleaning area or chamber. The secondary brush member(s) is located radially alongside the primary brush member. A closure cap is removably secured to the second end of the housing. A stabilizing plate is positioned between the second end of the housing and the closure.

Figure 1:
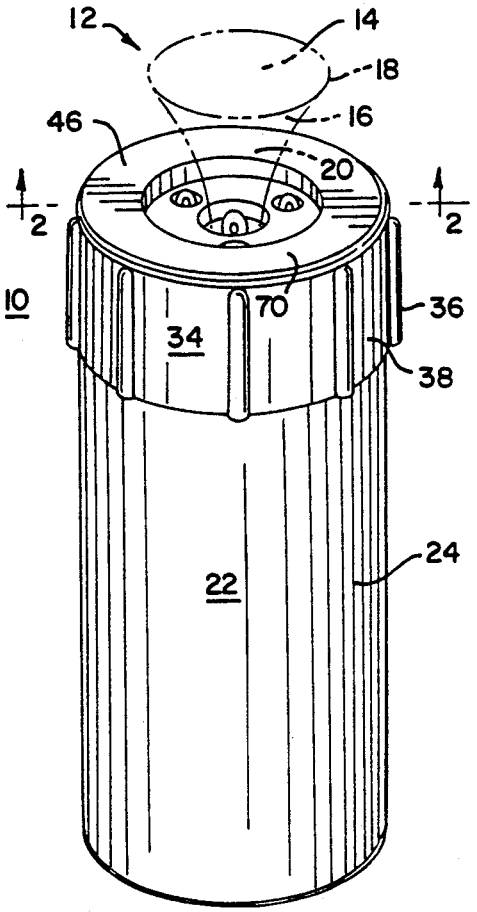
FIG. 1 is a perspective view of the present speculum cleaner.
Figure 2:
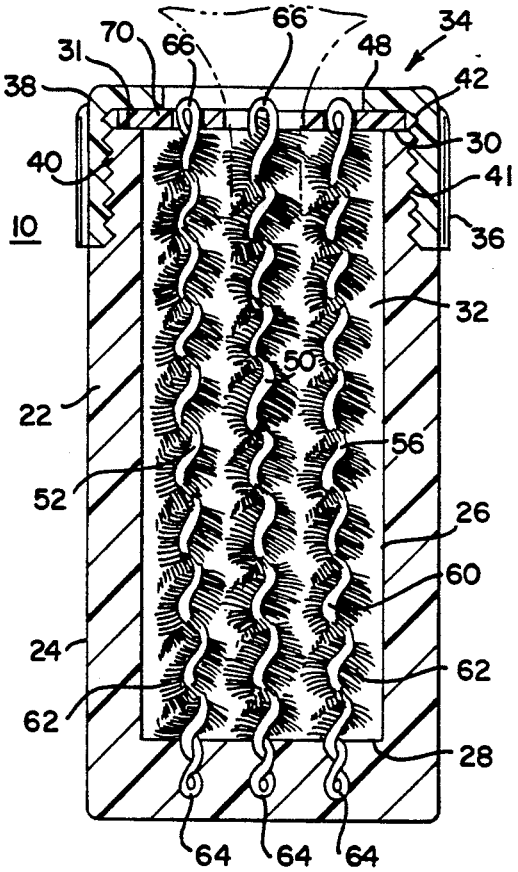
FIG. 2 is a cross-sectional side view of the speculum cleaner of FIG. 1 taken along the line 2.

Referring now more particularly to the drawings, and specifically FIGS. 1 and 2, the present speculum cleaner is designated at 10. It is contemplated that the present speculum cleaner 10 will be utilized to clean typically used medical speculums or speculum-like items, such as speculum 12. Medical speculums are commonly used by doctors to examine and even medicate body passageways of canals that are otherwise too difficult to penetrate without harming the patient. The speculum 12 is ordinarily used in conjunction with a medical instrument, such as an otoscope, which is used to examine ear and nose canals.

Typically, medical speculums, such as speculum 12, include an inner surface 14 and an outer surface 16. Further, as shown, speculum 12 is generally conically shaped having a viewing end 18 and a tip or an insertion end 20. It is the inner surface 14 and the outer surface 16 of the insertion end 20 that usually comes in contact with the patient, and therefore, becomes soiled with residue and must be cleaned and disinfected prior to using the speculum 12 again on another patient. The insertion end 20 is the most narrow portion of the speculum and the portion which is most difficult to clean or disinfect adequately. Accordingly, the cleaning action which results from the insertion of the speculum 12 into the speculum cleaner 10 is primarily directed to removing the residue which forms on the insertion end 20 of the speculum 12.

Referring now more specifically to the invention itself, in FIGS. 1 and 2 it is shown that the speculum cleaner 10 consists of a central body portion or housing 22. As shown, the housing 22 may have a generally cylindrically configuration and resemble on ordinary container. It is contemplated that different configurations for the housing 22 may be utilized, such as a rectangular shape, without departing from the principles of the present invention. However, for easy transportability and handling, it is preferred that the housing be cylindrical and dimensioned to be easily grasped by the user. The housing may be made of any sufficiently rigid material, such as polystyrene or polyvinyl chloride (PVC).

Referring now to FIG. 2, the housing 22 has an outer surface 24 and an inner surface 26. The housing 22 further includes a lower end 28 and an upper end 30. The upper end 30 has a mouth or upper edge 31. The lower end 28 will typically be closed so that the cleaner 10 will retain the disinfectant fluids that may be supplied or utilized with the cleaner 10. The inner surface 26 and the lower end 28 form an interior chamber or an inner cleaning area 32 within the housing 22. It is preferred that the housing 22 be substantially leak-proof to contain cleaning solution. It is contemplated that the cleaning solution will include alcohol or soap solutions. The upper end 30 is substantially open, and provides access to the inner cleaning area 32 and must be dimensioned to allow easy and unobstructed insertion of the speculum 12 into the cleaner 10.

Figure 3:
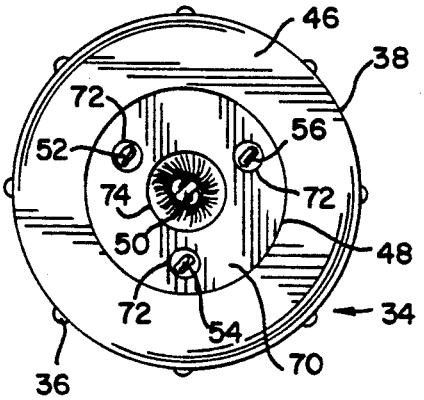
FIG. 3 is a plan view of the present speculum cleaner.
Figure 4:
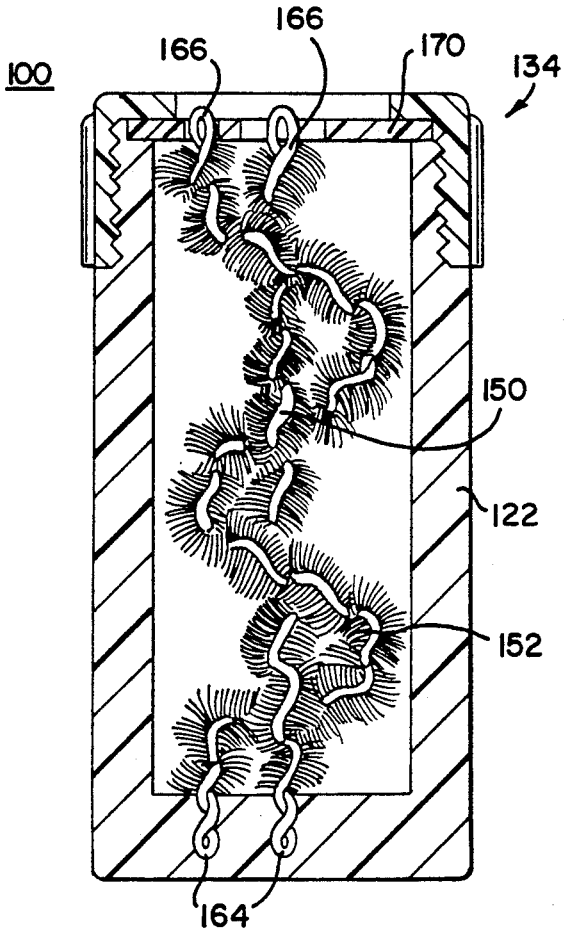
FIG. 4 is a cross-sectional view of an alternative embodiment of the present speculum cleaner.

Referring to FIGS. 2 and 3, it is contemplated that a closure cap 34 will be included to aid in retaining the cleaning solution within the housing 22 and to help align and retain the cleaning members in a desired position within the inner cleaning area 32. Further, the closure cap 34 may include ridges 36, which are integrally formed on an outer surface 38 of the closure cap 34 to facilitate the application and removal of the closure cap 34 from the housing 22. Threading 40 that is formed on the upper end 30 of the housing 22 is configured to matingly engage with complimentary threading 41 formed on an inner surface 42 of the closure cap 34. Further, closure cap 34 is configured with an upper surface 46, which has a centrally formed cavity 48. It is preferred that the diameter of the cavity 48 be somewhat smaller than the diameter of the upper end 30 of the housing 22, since it is only necessary that the cavity 48 be dimensioned to provide unobstructed access to the inner cleaning area 32 of the housing 22. Further, it is preferred that there be at least sufficient upper closure area on the upper surface 46 to provide an abutting or securing surface against the upper end 30 of the housing 22. The upper surface 46 will help to retain the contents held within the inner cleaning area 32 when the closure cap 34 is threaded onto the housing 22.

In the preferred embodiment, the cleaning action of the cleaner 10 is the result of a plurality of brush members which are positioned within the inner cleaning area 32 of the housing 22 to correspond with the inner surface 14 and the outer surface 16 along the insertion end 20 of the speculum 12. As shown most clearly in FIG. 2, a primary cleaning stem or first brush member 50 is positioned centrally within the inner cleaning area 32 of the housing 22. The primary brush member 50 is surrounded by a plurality of cleaning stems or secondary brush members 52, 54 and 56 (referring to FIGS. 2 and 3). The brush members 50, 52, 54 and 56 are each configured of a stem or post 60 having radiating bristles 62. The bristles 62 should be of a sufficient rigidity to remove hardened residue without significant deformation, but not too rigid so as to damage the speculum 12. Further, the brush members 50, 52, 54 and 56 each have a lower end or securing end 64 and an upper end or bristle end 66.

The primary brush member 50 is situated within the inner cleaning area 32 of the housing 22 to provide for the cleaning action of the inner surface 14 of the insertion end 20 of the speculum 12. The secondary brush members 52, 54 and 56 are positioned axially alongside the primary brush member 50 and should generally be the length of the primary brush member 50 to provide for the cleaning action on the outer surface 16 of the insertion end 20 of speculum 12. It is preferred that at least three secondary brush members be utilized, and that the distance between each of the secondary brush members 52, 54 and 56 be substantially equal. Other arrangements are also contemplated, such as where the distance between each of the secondary brush members 52, 54 and 56 is unequal to provide a specific cleaning action on the outer surface 16 of the speculum 12. Further, to maximize the cleaning ability of the brush members 52, 54 and 56, it is preferred that the bristles 62 of the brush members 52, 54 and 56 virtually touch or overlap the bristles 62 of the primary brush member 50. The number, size and length of the brush members can be varied to correspond with differing speculum configurations without departing from the principles of the present cleaner 10.

As shown in FIG. 2, the secondary brush members 52, 54 and 56 are mounted vertically within the inner cleaning area 32 of the housing 22, and are parallel with respect to the primary brush member 50. However, it is contemplated that the brush members 52, 54 and 56 can be slightly skewed, spiraled or curved alongside the primary brush member 50 as they extend upwards from their securing end 64. To prevent the undesired movement of the brush members 50, 52, 54 and 56, they may be fixed or anchored to the lower end 28 of the housing 22. To insure that the brush members 50, 52, 54 and 56 remain anchored within the housing 22, epoxy or other solidifying adhesives can be used. Alternatively, it is conceivable that the brush members 50, 52, 54 and 56 will be removably secured to the lower end 28 of the inner cleaning area 32 so that the brush members themselves can be removed for cleaning, disinfecting or eventual replacement.

To further prevent the brush members 50, 52, 54 and 56 from movement or deformation during use, a securing plate 70 may be included between the upper edge 31 of the housing 22 and the closure cap 34. The diameter of the securing plate 70 is substantially the diameter of upper end 30 of the housing 22, thereby covering substantially all of the opening at the upper end 30. Referring more particularly to FIG. 3, the securing plate 70 is configured having outer apertures 72 and an inner aperture 74. The aperture 72 is arranged to accept the secondary brush members 52, 54 and 56, while aperture 74 is generally centrally located to accept the primary brush member 50. The diameter of aperture 74 must be large enough to permit easy entry of the insertion end 20 of the speculum 12 into the cleaner 10, while directing primary brush member 50 into contact with the inner surface 14 of insertion end 20. The apertures 72 and 74 allow the upper end 66 of each respective brush members to extend through the plate 70 so that they are prevented from horizontal movement and are maintained in a stable, upright position.

It is important that the speculum 12 is thoroughly cleaned before it can be sterilized properly. With the present speculum cleaner 10, the user need only stroke the speculum into the cleaner 10 a few times before it is thoroughly cleaned. Additionally, the cleaner 10 itself is self-cleaning. Each time the cleaner 10 is used, the bristles 62 are massaged or stroked downwards into the cleaning solution that is contained within the cleaning area 32. Further, upon changing the cleaning solution, the user need only shake the cleaner 10 to effectively clean and prepare the bristles 62 of the brush members 50, 52, 54 and 56 for the next use.

Figure 5:
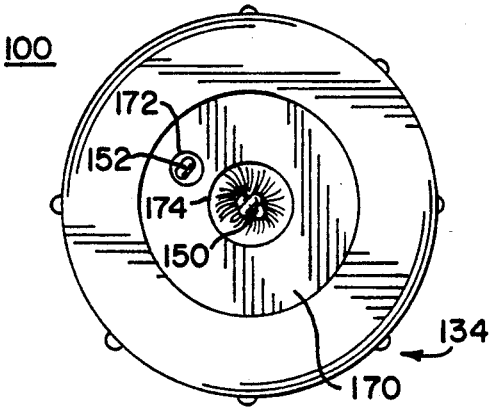
FIG. 5 is a plan view of an alternative embodiment of the present speculum cleaner.

In an alternative embodiment, referred to generally as speculum cleaner 100, the housing 122, closure cap 134 and securing plate 170 are all configured identically to the preferred embodiment described in cleaner 10. However, in the alternative embodiment of cleaner 100, there are only two brush members, a primary brush member 150 and a single secondary brush member 152. The secondary brush member 152 spirals or twists up from its lower end 164 through to its upper end 166 around the radius of primary brush member 150. As shown in FIG. 5, because there are only two brush members utilized in cleaner 100, the securing plate 178 requires only one outer aperture 172 and one inner centrally located aperture 174. As with cleaner 10, the apertures 172 and 174 serve to stabilize the upper ends 166 of each brush member 150 and 152. The advantage of the alternative embodiment is in terms of the costs, since there are only brush members 150 and 152 and less apertures to machine on the securing plate 172.

Figure 6:
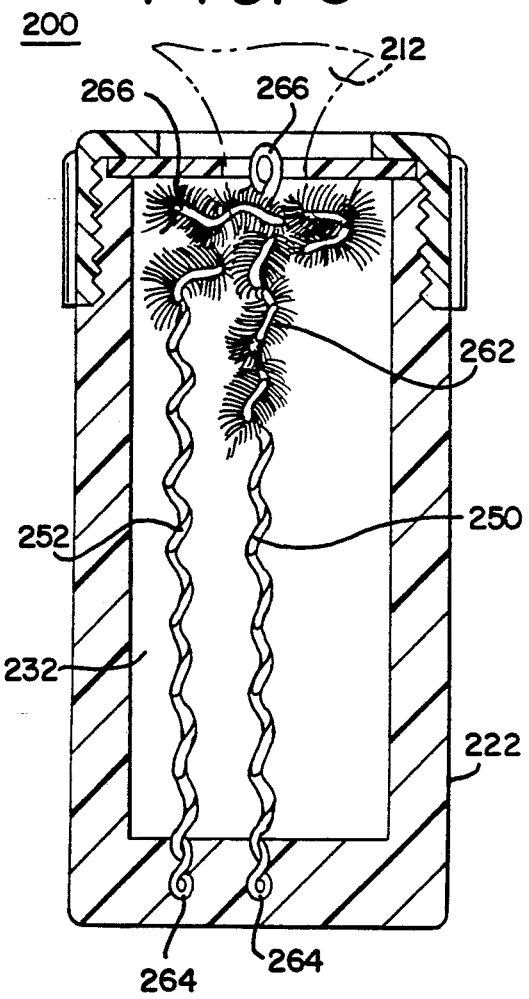
FIG. 6 is a cross-sectional view of another alternative embodiment of the present speculum cleaner.

Shown in FIG. 6 is yet another alternative embodiment of the present speculum cleaner 10. The cleaner of FIG. 6 is referred to generally as cleaner 200. The cleaner 200 utilizes the concept of cleaner 100, wherein only two brush members are needed. Again, a primary brush member 250 is anchored at its securing end 264 within the cleaning area 232 of the housing 222 and extends vertically upwards. The brush member 250 includes bristles 262 only at its upper end 266. A secondary brush member 252 is also anchored within the housing 222 and extends vertically upwards alongside brush member 250. The brush member 252 terminates at an upper end 266, which has bristles 262. Unlike the various other configurations of the present cleaner 10, here the brush members 250 and 252 wraps around the primary brush member 250 only at the uppermost portion of the upper end 266. As shown, the brush member 252 circumscribes brush -member 250 only once, but it is contemplated that it may wrap around several times to increase the cleaning action and the number of bristles which are applied to the speculum 212 during each stroke into the cleaner 200. Since the speculum 212 will not extend the length of the brush member 250, the brush members 250 and 252 need only have bristles 262 located at their uppermost end 266. To insure that the upper end 266 of the brush member 252 stays sufficiently stable around brush member 250, the brush member 252, and particularly bristles 262 may be secured to the inner surface 226 of the housing 222 such as with adhesive or epoxy, as shown in FIG. 6.

In operation, the user, typically the doctor or the assistant, will insert the insertion end 20 of the speculum 12 into the cleaner 10 through the inner aperture 74. The diameter of the inner aperture 74 is large enough to fully accept the insertion end 20 of the speculum 12, while helping to direct the primary brush member 50 into the insertion end 20. It is important to realize that the user can remove the speculum from the instrument before cleaning the speculum with cleaner 10, or may leave the speculum 12 on the instrument during cleaning to maximize time and costs savings. However, to minimize the possibility of damage to the instrument, the doctor will typically remove the instrument for cleaning and disinfecting.

Once the insertion end 20 has been fed into the cleaner 10 through the inner aperture 74, the user may operate the cleaning action of the brushes 50, 52, 54 and 56 by rotating or twisting the speculum 12 while in the cleaner 10. Further, the user may find it necessary to repeatedly insert and remove, if only partially, the insertion end 20 of the speculum 12 in order to more thoroughly clean both the inner surface 14 and the outer surface 16 of the speculum 12 from residue which may be more difficult to clean properly by merely rotating the speculum within the cleaner 10. It should be understood that the amount of rotation and scrubbing needed to fully clean the entire radius of the outer surface 16 along the insertion end 20 will depend on the number of secondary brushes which are employed within the cleaner 10. Configuring the cleaner 10 with a greater number of secondary brushes will clean the outer surface 16 of the speculum 12 with a lesser amount of rotation and scrubbing. In the alternative embodiments 100 and 200 it is the number and density of wraps around the primary brush member 150 and 250 that determine the amount of surface area the bristles will contact.

The operation of the alternative embodiment, cleaner 100, is practically identical to that of the preferred, cleaner 10. The only significant difference is that the user may be required to rotate the speculum 12 a greater amount, since the secondary brush member 152 can only contact a limited amount of the outer surface 116 of speculum 112. However, in the alternative cleaner 200, since the brush member 252 is wrapped around brush member 250, virtually the entire outer surface 216 of speculum 212 will contact bristles 262. Thus with cleaner 200 the user may only need to stroke the speculum a couple of times to clean it properly. Also, it is anticipated that the present speculum cleaner 10, 100 or 200 may be adapted to clean other medical apparatus, such as reusable examining probes, depressors and the like.

If cleaning solution is utilized with the cleaner 10, then as the insertion end 20 of the speculum 12 is inserted, turned and removed the bristles 62 of the brush members 50, 52, 54 and 56 will scrub and simultaneously distribute the cleaning solution onto the inner surface 14 and outer surface 16 of the speculum 12 to further facilitate the removal of residue from the speculum 12. It is contemplated that cleaning solution will be desired, since the cleaning solution aids in the proper cleaning of the speculum 12 and helps to clean the bristles 62 during use of the cleaner 10. Also, the cleaning solution may facilitate the removal of residue from the brush members 50, 52, 54 and 56 by softening any film or stains. It should be understood that the cleaning solution will need to be changed following the cleaning of a predetermined number of speculums.

The inherent advantage of the present cleaner 10, 100 or 200 is that it encourages frequent and effective cleaning of speculums. The device is self-cleaning, requiring only minimal time to change the cleaning solution. Also, the present cleaner 10 can be easily adapted to step up the aggressiveness of the cleaning process. Most importantly, the cleaning action of the present cleaner 10, 100 or 200, effectively prepares the speculums so that they can be properly sterilized or sanitized.

Accordingly, the present speculum cleaner 10, 100 or 200 greatly reduces the amount of time a doctor or assistant expends to clean speculums using other available methods. It provides a doctor with an inexpensive alternative to merely disposing of the used speculums. The cleaner 10 is easily transportable, thereby allowing the doctor to carry and use the cleaner 10 in the field during house calls. By recycling the speculums, both the consumer and the environment benefits. Further, the low cost and specified configuration of the cleaner 10, 100 or 200 is such that manufacturers of products, such as cleaning or disinfectant solutions, may find it useful as a promotional vehicle for their products.

While various embodiments of the present invention have been shown and described, it should be understood that various other alternatives, substitutions and equivalents can be used, and the present invention should only be limited by the claims and equivalents thereof. Therefore, the terms and expressions serve only to describe the invention by example only and not to limit the invention. It is expected that others will perceive differences which, while differing for the foregoing, do not depart from the spirit and its scope of the invention herein described and claimed.

Various features of the present invention are set forth in the following claims.

What is claimed is:

1. A transportable cleaning apparatus for cleaning speculums of the type which are generally conically configured and which have an insertion end, comprising:

a sufficiently rigid and generally cylindrical housing defining an inner cleaning area, said housing having a first end and a second end, said first end being closed and said second end providing access to said inner cleaning area;

at least one primary brush member having a first end and a second end opposite said first end, said first end of said at least one primary brush member being secured to said first end of said housing within said cleaning area, said second end of said at least one primary brush member being configured with radiating bristles;

at least one secondary brush member having a first end and a second end opposite said first end, said first end of said at least one secondary brush member being secured to said first end of said housing within said inner cleaning area, said at least one secondary brush member being arranged so as to circumscribe at least said second end of said at least one primary brush member, and a closure being removably secured to said second end of said housing, said closure having an upper surface provided with an opening, said opening substantially corresponding in diameter with the diameter of said second end of said housing.

2. The cleaning apparatus as defined in claim 1 wherein said inner cleaning area of said housing is adapted to retain a predetermined amount of cleaning solution.

3. The cleaning apparatus as defined in claim 1 wherein the diameter of said primary brush member is larger than the diameter of the insertion end of the speculum so as to force said bristles against the surface of said insertion end and to provide a cleaning action when the speculum is inserted into the container for cleaning.

4. The cleaning apparatus as defined in claim 1 further including stabilizing means for stabilizing and restricting the movement of said second end of said at least one primary brush member and said second end of said at least one secondary brush member within said housing.

5. A hand-held cleaning apparatus for cleaning speculums of the type which are generally conically configured and having an insertion end, comprising:

a sufficiently rigid and generally cylindrical housing defining an inner cleaning area, said housing having a first end and a second end, said first end being closed and said second end providing access to said inner cleaning area;

a primary brush member having a first end and a second end opposite said first end, said first end of said primary brush member being secured to said first end of said housing within said inner cleaning area, said second end of said primary brush member having radiating bristles;

at least one secondary brush member having a first end and a second end opposite said first end, said first end of said at least one secondary brush member being secured to said first end of said housing within said inner cleaning area, said at least one secondary brush member being located radially alongside said primary brush member, said at least one secondary brush member being configured and arranged relative to said primary brush member so as to spiral substantially around said primary brush member; and a closure cap being removably secured to said second end of said housing, said closure having an upper surface provided with an opening, said opening being dimensioned to substantially correspond in diameter with the diameter of said second end of said housing.

6. The cleaning apparatus as defined in claim 5 wherein said at least one primary brush member and said at least one secondary brush member are elongated and are at least the length of said inner cleaning area of said housing.

7. The cleaning apparatus as defined in claim 5 wherein said at least one primary brush member and said at least one secondary brush member are arranged such that the distance between said primary brush member and said at least one secondary brush member is sufficient to accept therebetween the insertion end of the speculum for cleaning.

8. The cleaning apparatus as defined in claim 5 further including stabilizing means for stabilizing and restricting the movement of said second end of said primary brush member and said second end of said at least one secondary brush member, said stabilizing means positioned between said second end of said housing and said closure.

9. A transportable cleaning apparatus for cleaning speculums of the type which are generally conically configured and which have an insertion end, comprising:

a sufficiently rigid and generally cylindrical housing defining an inner cleaning area, said housing having a first end and a second end, said first end being closed and said second end providing access to said inner cleaning area;

a primary brush member having a first end and a second end opposite said first end, said first end of said primary brush member being secured to said first end of said housing, said second end of said primary brush member being free and configured with radiating bristles;

at least one secondary brush member having a first end and a second end opposite said first end, said first end being secured to said first end of said housing within said inner cleaning area, said second end of said at least one secondary brush member being configured so as to circumscribe at least said second end of said primary brush member;

a closure being removably secured to said second end of said housing, said closure having an upper surface provided with an opening, said opening substantially corresponding in diameter with the diameter of said second end of said housing; and stabilizing means for stabilizing and restricting the lateral movement of said second end of said at least one primary brush member and said second end of said at least one secondary brush member within said housing.

* * * * *